US006336293B1

(12) United States Patent
Kamimura

(10) Patent No.: US 6,336,293 B1
(45) Date of Patent: Jan. 8, 2002

(54) DOOR OF LAVATORY UNIT

(75) Inventor: Hiroshi Kamimura, Tokyo (JP)

(73) Assignee: Jamco Corporation, Tokyo (JP)

( * ) Notice: Subject to any disclaimer, the term of this patent is extended or adjusted under 35 U.S.C. 154(b) by 0 days.

(21) Appl. No.: 09/614,457

(22) Filed: Jul. 12, 2000

(30) Foreign Application Priority Data

Jul. 15, 1999 (JP) ..... 11-005305

(51) Int. Cl.[7] ..... E06B 7/28
(52) U.S. Cl. ..... 49/171; 49/463
(58) Field of Search ..... 49/163, 168, 169, 49/171, 463; 52/302.1

(56) References Cited

U.S. PATENT DOCUMENTS 1,958,342 A * 5/1934 Johnson ..... 49/171 X
2,398,914 A * 4/1946 Barrowclough ..... 49/171 X
2,778,417 A * 1/1957 Novitz ..... 49/171 X
4,644,687 A * 2/1987 Liou ..... 49/171 X

* cited by examiner

*Primary Examiner*—Jerry Redman
(74) *Attorney, Agent, or Firm*—Armstrong, Westerman, Hattori, McLeland & Naughton, LLP

(57) ABSTRACT

A door provided to a lavatory unit allowing the access of users is equipped with a vent louver mounted to an opening perforated to the lower portion of a door body 110 via a frame 115 of the door. The vent louver 130 comprises a ventilation 131 having plural air holes, a mounting portion 133 provided to the upper side of the ventilation 131 and equipped to the door body 110 with a fastener 140, and a mounting portion 135 for fixing the lower portion of the ventilation 131 to the door body via the door frame 115. The lower mounting portion 135 of the vent louver 130 comprises a connector 135F connected to the outer wall of the frame 115, and an elastic connector 135S comprising a leaf spring 1350 inserted to the frame 115 and flexibly applied to the inner wall of the frame. When the fastener of the upper mounting portion 130 is taken off and the vent louver is at an opened condition, it is able to rotate in direction O perpendicular to the door surface centering on elastic connector of the lower mounting portion, so that it could be dismounted from the door body 110.

3 Claims, 5 Drawing Sheets

DOOR OF LAVATORY UNIT

FIELD OF THE INVENTION

The present invention relates to a door of a lavatory unit provided inside a closed space, and particularly, to a door equipped with a vent louver for providing air into the lavatory unit.

DESCRIPTION OF THE RELATED ART

The lavatory unit equipped inside a closed space, in an airplane for example, includes a vent louver mounted to its door, having air holes allowing air to flow into the lavatory unit. The vent louver is provided to the lower area of the door, and therefore, dusty air existing near the floor flows through continuously. Therefore, the vent louver was liable to collect dust.

The structure of the conventional lavatory unit will be explained with reference to FIG. 5.

A door 11 allowing access of lavatory users is equipped to a lavatory unit 10.

A vent louver 13 having air holes 15 is mounted to the lower portion of the door 11. Further, an exhaust port 17 connected to a vacuum mechanism is provided to a ceiling 12 of the lavatory unit 10. The air inside the cabin is taken into to the lavatory unit 10 by discharging the air inside the lavatory unit 10 through the exhaust port 17 as shown by arrow a, and air within the cabin is flown into the lavatory unit 10 through the air holes 15 of the vent louver 13 mounted to the door 11 by the intake of the air in the direction of arrow a.

In the conventional lavatory unit 10 having the structure mentioned above, when the dust is gathered to the vent louver 13, the flow of air is blocked, and the cleaning of air inside the lavatory unit 10 is not carried out well, thereby making users feel uncomfortable.

In such case, the vent louver 13 is taken off from the door 10 and cleaned in order to evacuate the plugging of the air hole 15 of the vent louver.

However, the vent louver 13 is inserted to the disposition port of the door 11, and fixed at the bottom to the frame 11*a* of the door with a fastener 19. In order to dismount the vent louver 13 from the door 11, it is necessary to dismount the door 11 from the lavatory unit 10 and to take off the fastener 19 of the frame 11*a*.

Further, even when the door 11 is dismounted from the lavatory unit 10, the door is handled in inverted position, so it is difficult to carry out the dismounting operation of the vent louver 13.

Therefore, the cleaning of the vent louver in airplanes has been a very difficult task.

SUMMARY OF THE INVENTION

Therefore, the present invention aims at providing a door of a lavatory unit which enables simple dismount of the vent louver. Thereby, the air inside the lavatory unit provided in a closed space is maintained clean, and the users feel more comfortable.

The door according to the present invention of the lavatory unit allowing users to access said lavatory unit is equipped with a vent louver mounted to an opening perforated on the lower portion of a door body via a frame of the door.

The vent louver comprises a ventilation having a plurality of air holes provided to the central portion thereof, amounting portion fixed with fasteners to the door body provided to the upper portion of the ventilation, and a mounting portion for mounting the lower portion of the ventilation to the door body via the door frame. Also, the mounting portion on the lower portion of the vent louver comprises a connector connected to the outer wall of the frame, and an elastic connector inserted to the frame and flexibly connected to the inner wall of the frame. When the vent louver is in an opened condition having the fastener of the upper mounting portion taken off, it is rotatable in the direction perpendicular to the door surface centering on the elastic connector of the lower mounting portion, so that it is able to be detached from the door body.

The lower portion of the vent louver grips the frame with the connector and the elastic connector. Also, the elastic connector of the lower mounting portion is provided with a leaf spring which is biased toward the inner wall direction of the frame when the lower mounting portion is inserted and provided in the frame.

DETAILED DESCRIPTION OF PREFERRED EMBODIMENTS

Figure 1:
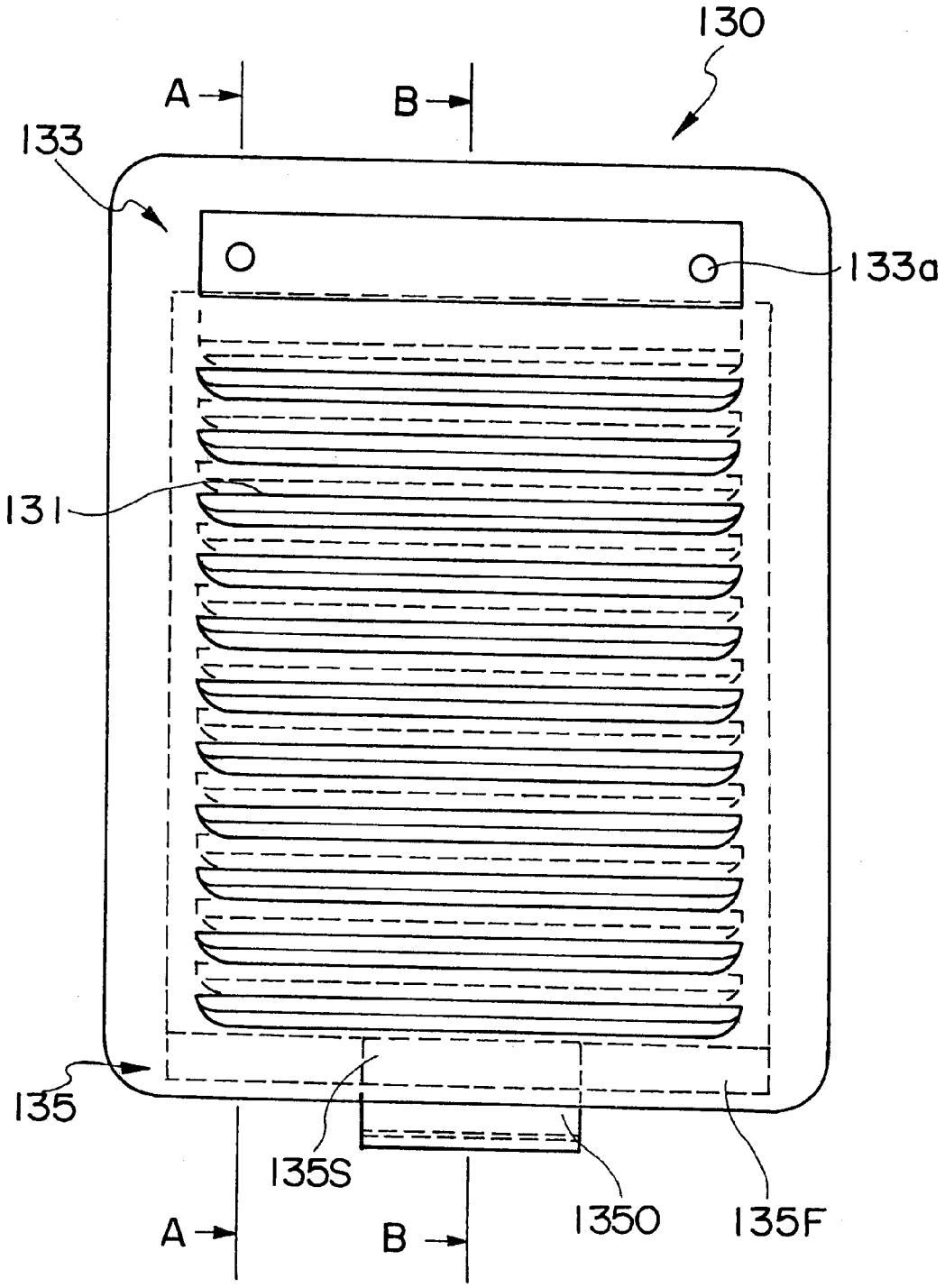
FIG. 1 is a front view of the vent louver according to the present invention.

The embodiment of the invention will now be explained referring to the drawings.

Figure 4:
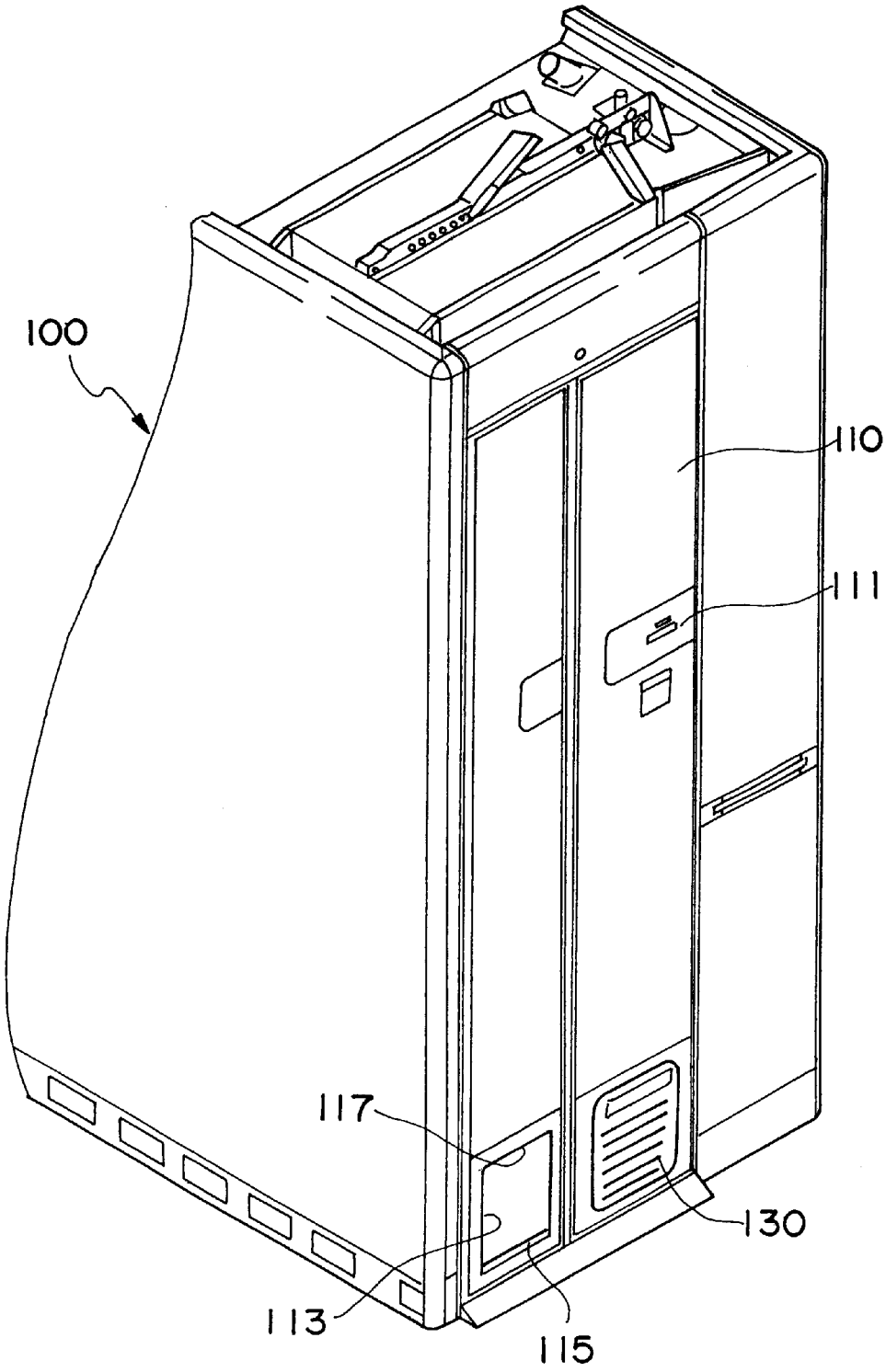
FIG. 4 is a perspective view of the lavatory unit according to the present invention.
Figure 5:
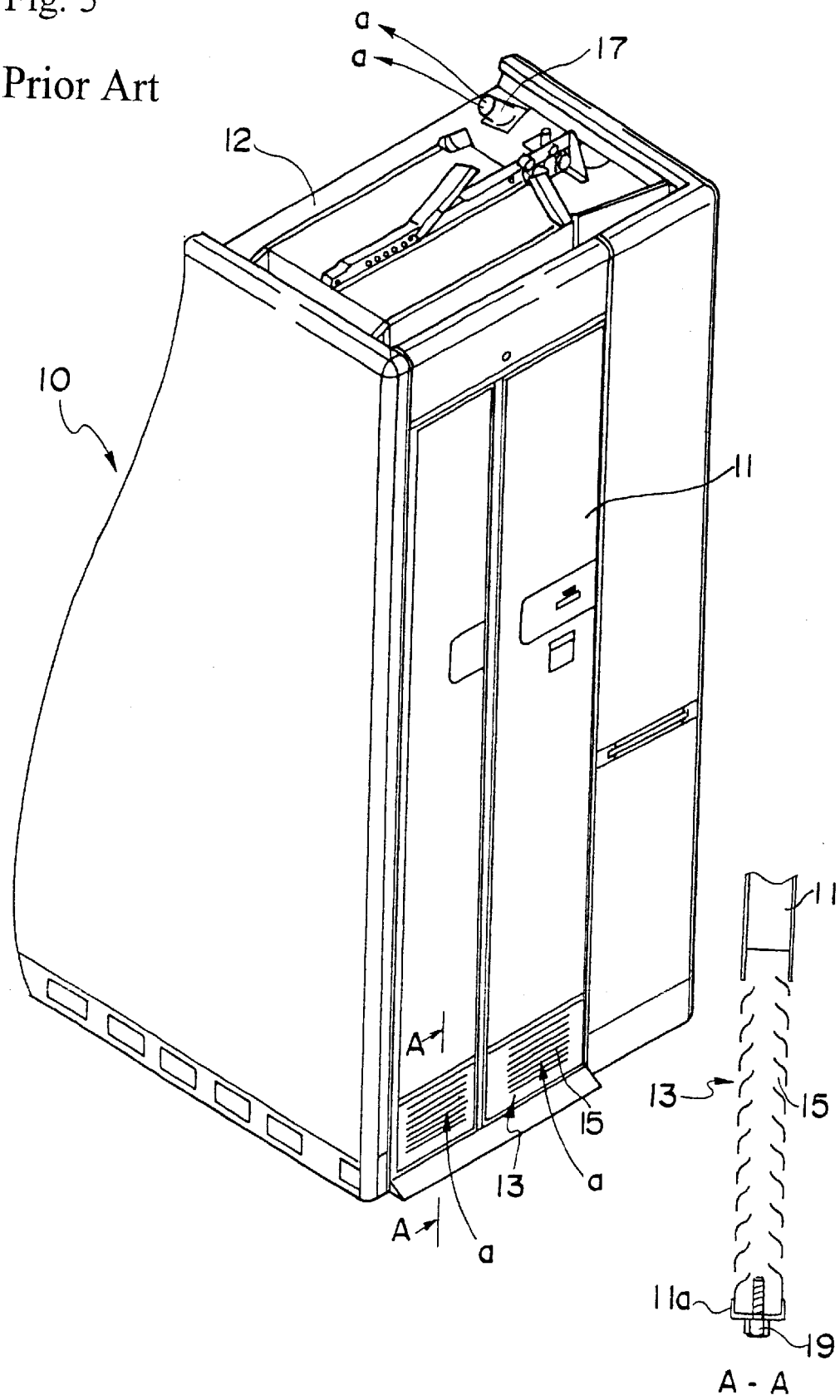
Fig. 5 Prior Art
FIG. 5 is a perspective view of the conventional lavatory unit.

FIG. 4 is a perspective view of the fundamental section of a lavatory unit 100 equipped with a door of the present invention.

To the center of a door body 110 of the lavatory unit 100, there is provided a latch 111 allowing a user to lock the door. To the lower portion of the door body 110, there is provided a plurality of openings, a plurality of mounting holes 113, for mounting plural vent louvers 130. Generally, two vent louvers are provided thereto. However, the drawing shows the state where one vent louver is taken off (mounting hole 113) for explanation. To the mounting hole 113 of the door body 110, a fastening hole 117 for mounting the vent louver 130 is perforated.

Next, the composition of the vent louver 130 will be explained referring to FIGS. 1 and 2.

The vent louver 130 has a ventilation 131 having a ventilation structure and provided to the center of the vent louver, an upper mounting portion 133 provided continuously at the upper part of the ventilation 131, and a lower mounting portion 135 provided continuously at the lower part of the ventilation 131.

The ventilation 131 is comprised of two boards, each provided with a plurality of air holes 131*a* opened downwardly.

The upper mounting portion 133 is made by superposing two plates, and a mounting hole 133*a* for mounting the fastener is opened to both ends thereof. The upper mounting portion 133 is mounted by matching the mounting hole 133*a* to the fastening hole 117 of the fitting hole 133 of the door body 110.

The lower mounting portion 135 has an elastic connector 135S at the center thereof, and having at both sides thereof a connector 135F for being connected to the door frame and having a substantially L-shaped cross section.

The elastic connector 135S of the lower mounting portion 135 is provided with a leaf spring 1350 and a support plate 1355 for the leaf spring 1350 having a substantially Z-shaped cross section. The leaf spring 1350 is mounted to the lower mounting portion 135, with one end of the leaf spring 1350 being fixed to one side of the support plate 1355, and the other ends being free ends.

Figure 3:
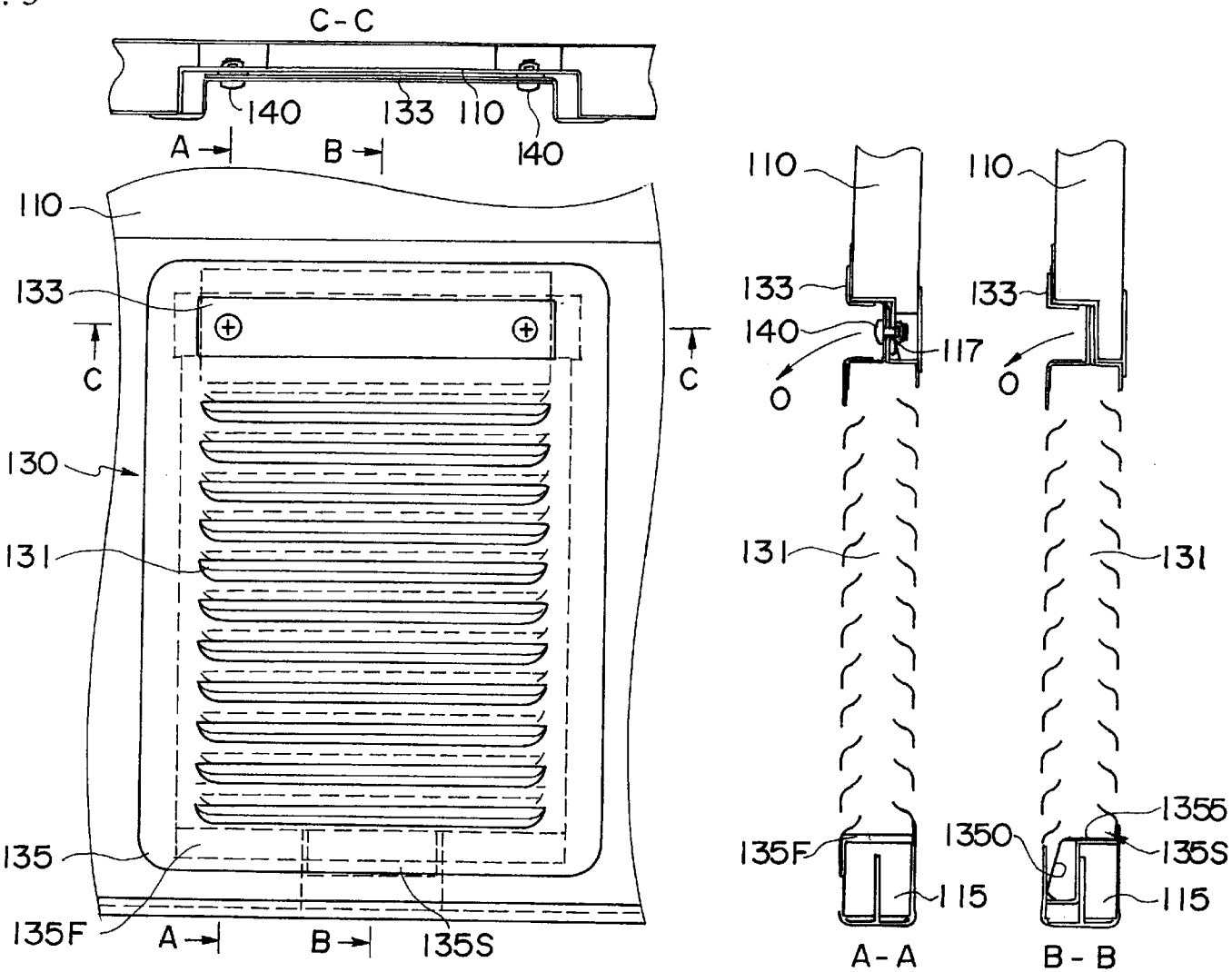
FIG. 3 is a partial front view and a cross-sectional view of the door equipped with the vent louver.

The vent louver 130 having the above-mentioned structure is mounted to the fitting hole 113 of the door body 110 (FIG. 3).

First, the lower mounting portion 135 of the vent louver 130 is equipped to the opening side of the frame 115 of the door body 110 having a substantially U-shaped cross section. One side of L-shaped connector 135F is connected to the frame 115, and the elastic connector 135S is inserted via the opening of the frame 115 so as to flexibly pressurize the leaf spring 1350 to the inner wall of the frame 115. The leaf spring 1350 is biased toward the direction of the inner wall of the frame 115, when being inserted inside the frame 115. The upper mounting portion 133 is mounted to the upper portion of the fitting hole 113 of the door, and the vent louver 130 is equipped to the door body 110 by fixing the fastener 140 via the fastening hole 117 of the door body and the hole 133*a* for the fastener of the vent louver 130.

Next, dismantlement of the vent louver 130 from the door body 110 will be explained.

Figure 2:
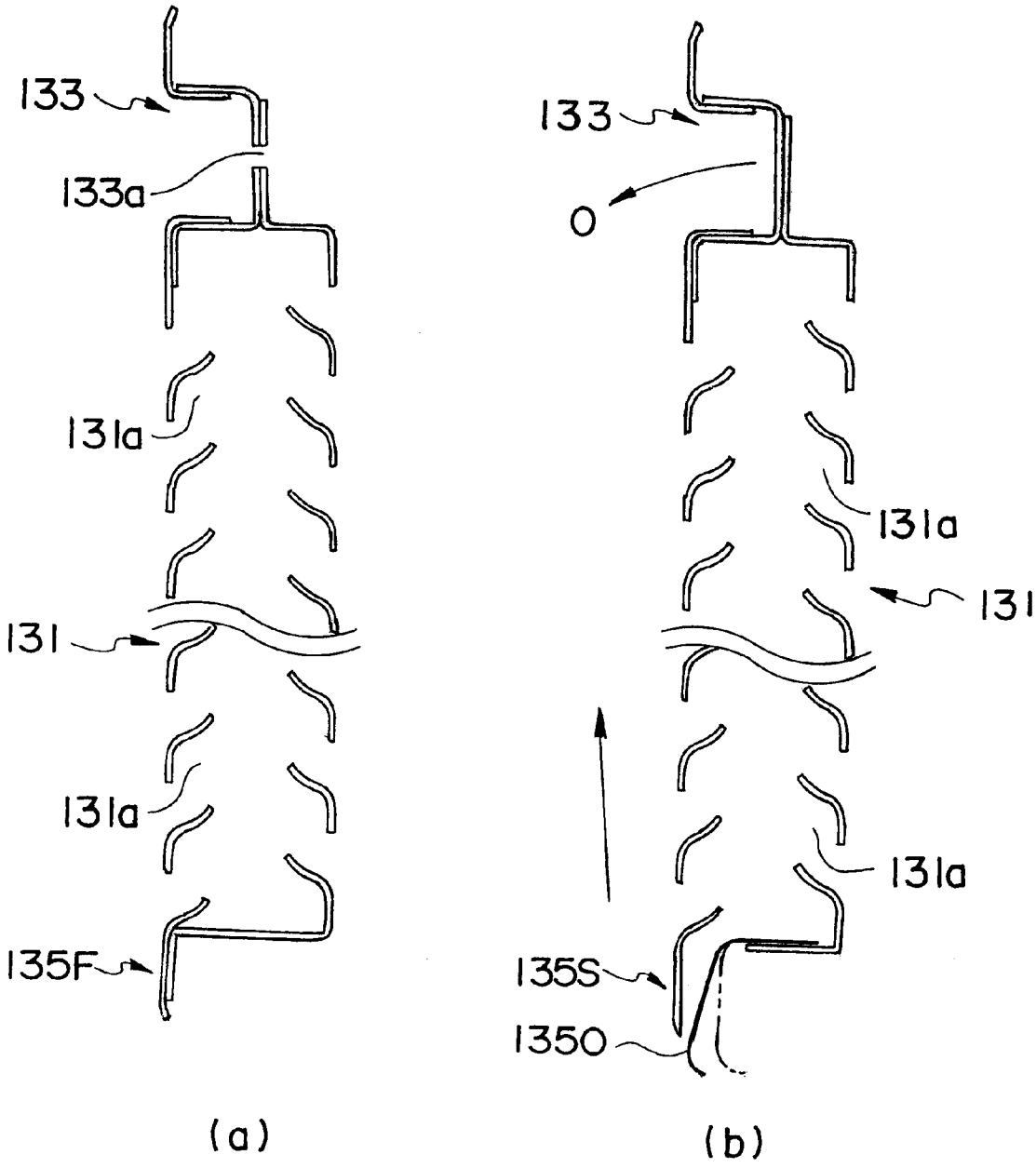
FIG. 2 is a cross-sectional view taken along line A—A and line B—B in FIG. 1.

First, the fastener 140 of the upper mounting portion 135 is removed, and the upper mounting portion 133 of the vent louver 130 is rotated about in the direction of arrow O shown in FIG. 2. Both ends of the lower mounting portion 135 of the vent louver are easily removed, since only one side of the L-shaped connector 135F is connected at the frame 115. As for the elastic connector 135S, the leaf spring 1350 rotates about centering on the contact point with the inner wall of the frame 115, accompanying the rotation of the vent louver 130. At this point, the leaf spring 1350 is pressed opposing to the bias force, and is removed from the frame 115.

As seen from above, the vent louver 130 of the present invention could be mounted to and dismounted from the door body 110 with ease, in which the door body 110 is equipped to the lavatory unit 110, by fastening and removing two fasteners 140 according to the present embodiment.

Moreover, by placing the upper mounting portion (fastening position) to the retracted position from the surface of the lower part of the door 110, and with the cabin generally being dim, it is hardly noticed by passengers or users, so the appearance of the door is maintained well.

According to the door body 110 having the above-mentioned structure mounted for example in an airplane, the removed vent louver 130 could be cleaned with air or water at a cleaning facility, and therefore, it is possible to clean the vent louver 130 with ease during everyday maintenance.

The door of a lavatory unit according to the present invention enables to mount and dismount the vent louver with the door being fixed to the unit, and therefore, the cleaning task is simplified.

I claim:

1. A door of a lavatory unit allowing users to access said lavatory unit, said door comprising a door body, an opening perforated to the lower portion of said door body, and a vent louver mounted to said opening via a frame of said door, wherein said vent louver comprises a ventilation having a plurality of air holes provided to the center portion of said vent louver, a mounting portion provided to the upper side of said ventilation for mounting said vent louver to said door body, and a mounting portion provided to the lower side of said ventilation for mounting said vent louver to said door body via said frame, said upper mounting portion of said vent louver being fixed to said door body with a fastener, said lower mounting portion of said vent louver comprising a connector connected to the outer wall of said frame, and an elastic connector inserted to said frame and flexibly connected to the inner wall of said frame, said vent louver being able to rotate in the direction perpendicular to said door surface centering on said elastic connector of said lower mounting portion, when said upper mounting portion is in an opened condition.

2. The door of a lavatory unit according to claim 1, wherein the lower portion of said vent louver grips said frame with said connector and said elastic connector.

3. The door of a lavatory unit according to claim 1, wherein a leaf spring being biased toward the inner wall direction of said frame when said vent louver is inserted and fixed to said frame is provided to said elastic connector of said lower mounting portion of said vent louver.

* * * * *